US009545608B2

(12) United States Patent
Kaufmann

(10) Patent No.: US 9,545,608 B2
(45) Date of Patent: Jan. 17, 2017

(54) DISPERSING DEVICE WITH TEMPERATURE SENSOR

(75) Inventor: Axel Kaufmann, Neuenburg (DE)

(73) Assignee: IKA—Werke GmbH & Co. KG, Staufen (DE)

( * ) Notice: Subject to any disclaimer, the term of this patent is extended or adjusted under 35 U.S.C. 154(b) by 836 days.

(21) Appl. No.: 13/824,748

(22) PCT Filed: Jul. 1, 2011

(86) PCT No.: PCT/EP2011/003273

§ 371 (c)(1),
(2), (4) Date: Mar. 18, 2013

(87) PCT Pub. No.: WO2012/041412

PCT Pub. Date: Apr. 5, 2012

(65) Prior Publication Data

US 2013/0176813 A1 Jul. 11, 2013

(30) Foreign Application Priority Data

Sep. 30, 2010 (DE) ..... 10 2010 047 199

(51) Int. Cl.

| | |
|---|---|
| ***B01F 15/00*** | (2006.01) |
| ***B01F 15/02*** | (2006.01) |
| ***B01F 7/00*** | (2006.01) |

(52) U.S. Cl.

CPC ..... *B01F 15/0227* (2013.01); *B01F 7/008* (2013.01); *B01F 15/00012* (2013.01); *B01F 15/0024* (2013.01); *B01F 15/00175* (2013.01); *B01F 15/00253* (2013.01); *B01F 15/00376* (2013.01)

(58) Field of Classification Search

CPC ..... B01F 15/00175; B01F 15/0024; B01F 15/0227; B01F 15/00253; B01F 15/00012; B01F 7/008; B01F 15/00376

USPC ..... 366/129, 279, 262–265, 270, 302, 305, 366/342, 343; 241/2, 46.11, 246, 101.8; 435/302.1

See application file for complete search history.

(56) References Cited

U.S. PATENT DOCUMENTS 4,745,068 A * 5/1988 Godfrey ..... B01F 7/00816 366/266
4,993,593 A * 2/1991 Fabiano ..... A47J 36/16 219/442
5,368,384 A * 11/1994 Duncan ..... A47J 43/044 219/227

(Continued)

FOREIGN PATENT DOCUMENTS

DE 1117546 11/1961
DE 9102202 7/1991

(Continued)

*Primary Examiner* — Charles Cooley
(74) *Attorney, Agent, or Firm* — Volpe and Koenig, P.C.

(57) ABSTRACT

A dispersing device (1) has a dispersing tool (3), which has a shaft tube (2), and a drive (4). A dispersing rotor is provided at the free shaft tube (2) end (5) remote from the drive (4), the dispersing rotor being connected to the drive (4) via a shaft which can be coupled to the drive (4) and which is arranged within the shaft tube (2). In order to monitor the temperature of the medium to be dispersed, a temperature sensor (7) with a corresponding electric input and output line (8) is provided on the shaft tube (2), which is stationary relative to the dispersing rotor and the rotatable shaft, the input and output lines (8) connecting the temperature sensor (7) to the drive (4) and/or analyzing electronics and/or a control or regulating device.

17 Claims, 2 Drawing Sheets

(56) References Cited

U.S. PATENT DOCUMENTS

| | | | | |
|---|---|---|---|---|
| 6,398,402 | B1 * | 6/2002 | Thomas | B01F 7/008 366/129 |
| 8,303,162 | B2 * | 11/2012 | Jagle | B01F 7/164 366/129 |
| 8,337,072 | B2 * | 12/2012 | Shimizu | A47J 43/044 366/129 |
| 2003/0206485 | A1 * | 11/2003 | Yacko | B01F 7/00016 366/343 |
| 2005/0058019 | A1 * | 3/2005 | Jahn | B01F 7/008 366/295 |
| 2005/0190642 | A1 * | 9/2005 | Jagle | B01F 7/008 366/129 |
| 2010/0300304 | A1 * | 12/2010 | Shimizu | A47J 43/0711 99/348 |
| 2011/0220751 | A1 * | 9/2011 | Jagle | B01F 7/164 241/101.8 |
| 2013/0176813 | A1 * | 7/2013 | Kaufmann | B01F 7/008 366/142 |
| 2015/0117136 | A1 * | 4/2015 | Eble | B01F 15/0035 366/142 |

FOREIGN PATENT DOCUMENTS

| | | | | |
|---|---|---|---|---|
| DE | 9214063 | | 1/1993 | |
| DE | 9320012 | | 2/1994 | |
| DE | 10113451 | A1 * | 10/2002 | B01F 7/00208 |
| DE | 102004009708 | | 9/2005 | |
| FR | 2139762 | | 1/1973 | |

* cited by examiner

DISPERSING DEVICE WITH TEMPERATURE SENSOR

BACKGROUND

The invention relates to a dispersing device comprising a dispersing tool, which has a shaft tube and on the free end of which, facing away from a drive, a dispersing rotor is provided which can be driven via a rotatable shaft connected to the drive and disposed in this shaft tube.

A comparable dispersing device is known from DE 10 2004 009 708 B3. Here, the simple handling involved in connecting the shaft tube and dispersing tool to its drive is favorable. In order to determine the temperature of the media to be dispersed, which temperature determination is in many cases desired, additional measures or instruments are necessary, which automatically implies corresponding expense.

SUMMARY

The object is therefore to provide a dispersing device of the type defined in the introduction, in which the advantage of simple handling of the shaft tube and dispersing tool is preserved and yet an easily manageable temperature determination is possible.

For the achievement of this object, it is provided that a temperature detector with an associated electrical input and output line is disposed on the fixed shaft tube.

As a result of the fitting of the dispersing tool and its shaft tube, a temperature detector with its input and output line, which temperature detector is responsible for monitoring the temperature, can thus also be fitted and connected. A separate installation of a temperature detector or a manual temperature measurement can be avoided by the—in particular fixed—connection of the temperature detector or sensor to the shaft tube.

It can here be of particular importance for the inventive dispersing device if the temperature detector is thermally isolated from the shaft tube which receives the shaft. It is thus possible that the temperature detector preferably measures the temperature of the surrounding medium to be dispersed. Any influencing of the measurement results due to the (frictional) heat generated during rotation of the shaft and/or its bearings can thus in all probability be avoided.

It can be particularly favorable if the temperature detector is disposed, such that it protrudes in angled-off and/or bent arrangement, on the outer side of the shaft tube, preferably in the region of that end of the shaft tube which is facing away from the drive. The protruding arrangement of the temperature detector on the outer side of the shaft tube can create an isolating distance to the shaft tube and enable the temperature detector in the usage position, apart from its fastening point to the shaft tube, to be surrounded by the medium to be dispersed, i.e. not to bear against the shaft tube. An accurate as possible determination of the temperature of the dispersing agent can thus be realized, since the temperature detector has a distance to the shaft tube and thus also to the rotating shaft and its bearing.

It can here be expedient if the temperature detector is pivotable away from the outer side of the shaft tube, via a pivot joint disposed on the shaft tube, from said pivot joint into its protruding usage position. By virtue of the pivot joint, the temperature detector, particularly in dispersion operations in which no temperature monitoring is necessary, can remain in its non-usage position or be pivoted back into this position in order to be better protected, for instance, from potential wear. As soon as temperature monitoring is required, however, the temperature detector, due to the presence of the pivot joint, can be pivoted away from the shaft tube into its protruding usage position in order to determine the temperature of the media to be dispersed.

It is here also possible for the temperature detector to be able to be deployed from the shaft tube by a spring force. Hence the temperature detector, for the introduction of the dispersing tool, for instance, into a narrow vessel opening, can firstly be pressed by a user into its non-usage position against the shaft tube so as not to impede, by a protruding temperature detector, the introduction of the shaft tube into the vessel opening. As soon as the dispersing device, comprising the dispersing tool having the shaft tube, is placed through the constriction inside the vessel and the temperature detector has passed the constriction, the temperature detector can be automatically deployed from the shaft tube into its designated usage position with the aid of the spring force.

For the extraction of the shaft tube from a narrow opening of this kind, it can also be favorable if that end of the temperature detector which is close to the free end of the shaft tube protrudes from the shaft tube. Upon passing the constriction, the temperature detector can be pressed counter to the spring force, purely by the extraction of the dispersing tool from the vessel and the passing of the constriction, into its non-usage position. A situation in which the temperature detector becomes damaged and/or gets caught in the constriction of the vessel can thus be avoided.

It is here particularly favorable if the temperature detector in the usage position protrudes from the shaft tube at an acute angle. The acute angle between the shaft tube and the temperature detector can facilitate the extraction of the dispersing tool from narrow openings.

Moreover, it can be advantageous if the input and output line connecting the temperature detector to an electronic evaluation unit and/or to a drive is disposed on the outer side of the shaft tube and/or within the shaft tube. A situation in which the input and output line of the temperature detector enters disturbingly, for example, into the turbulent region of the medium, which turbulent region is created during the dispersion, can thus be avoided. By virtue of such an arrangement directly on the shaft tube, the input and output line can also be well protected from possible damage during handling and operation of the dispersing device.

A particularly advantageous embodiment of the inventive dispersing device can provide that the input and output line is a metal and/or gold coating and/or an electrically conductive film, which is fastened, in particular, to the outer side of the shaft tube. A metal and/or gold coating as the input and output line for the temperature detector can be fastened to the shaft tube in a particularly space-saving and thus well-protected manner. The use of an electrically conductive film as the input and output line also constitutes a space-saving and well-protected connection of the temperature detector to the electronic evaluation unit and/or the drive. Such a configuration of the input and output line also promotes the cleaning of the shaft tube following its use.

If the input and output line of the temperature detector is disposed within a groove and/or recess provided, in particular, on the outer side of the shaft tube, it can be particularly well protected from damage and, where appropriate, can also be configured as a wire or stranded conductor.

A further measure for protecting the input and output line from damage, and particularly from possible dirt contamination, can be to recess the groove serving to receive the input and output line in the inner side of the shaft tube and/or in its inside surface.

It is also possible, however, for the input and output line to be formed by a cable and/or a cable connection.

In order, in particular, to protect a cable or a cable connection, the shaft tube can have a channel of optional cross section for the reception of the input and output line of the temperature detector. It is thus possible to run the input and output line up to the temperature detector in separate arrangement and, at least over a part-length of its extent, shielded from the medium and safely protected.

It can be favorable if the dispersing tool, for connection to the drive, has a plug-in coupling on that end of the shaft tube which in the usage position is facing the drive, the plug-in coupling having electrical contacts, in particular spring contacts, via which the input and output line of the temperature detector is electrically contacted with the drive and/or the electronic evaluation unit. While the plug-in coupling itself can initially serve for the mechanical coupling of the dispersing tool to the drive, the spring contacts enable the electrical connection between the drive and/or the electronic evaluation unit and the temperature detector. Since the electrical contacts, in the usage position of the metering tool, are completely covered, they can be safely protected from dirt contamination and/or damage. Furthermore, the mechanical and electrical connection of the dispersing tool can be realized in one operation.

Although a plug-in operation, distinct from the coupling of the metering operation, of a separate electrical plug-in connection disposed in the region of the plug-in coupling is conceivable, in this particularly advantageous embodiment of the invention it is able to be avoided.

For the use of the dispersing device in automatically controlled dispersion operations, it can also be expedient if the drive and/or the electronic evaluation unit has a control or regulating device for the drive for processing the measurement data of the temperature detector and for controlling or regulating the drive. Dispersing devices which are thus equipped also enable an automatic dispersion operation, which is independent of a user or operator and in which, for instance, the machining period and/or the speed at which the dispersing rotor is driven can be controlled and/or regulated in dependence on the temperature, measured by the temperature detector, of the medium to be dispersed.

A favorable embodiment of the invention can provide that the dispersing device has a display for displaying the operating parameters, in particular for displaying the temperatures measured by the temperature detector. Such a display allows visual monitoring of the dispersing device.

Moreover, it can be expedient if the temperature detector, in the usage position of the dispersing device, is arranged displaceably on the shaft tube in the vertical direction. It is thus possible to measure the temperature of the medium at different heights and/or at different distances to the dispersing rotor and to set the most favorable measuring position.

Another embodiment of the invention can provide that the dispersing device has in addition to the temperature detector a moisture sensor, which moisture sensor is preferably disposed at the same height or at roughly the same distance from the slotted region as the temperature detector on the shaft tube. With the aid of the moisture sensor, it can be possible to detect dry running of the dispersing device and to avoid consequential damage, in particular, to the bearing of the shaft, which bearing is lubricated and cooled by the medium to be dispersed. Particularly when the moisture sensor is disposed at the same height as the temperature detector on the shaft tube, it is possible to establish from the combination of measurement results of the two detectors or sensors whether the temperature detector is properly immersed in the medium and is thus measuring the temperature of the medium and not the temperature of the medium-free space.

To this end, it can be particularly advantageous if the moisture sensor is disposed at the same place as the temperature detector, in particular is connected and/or fastened thereto.

The temperature detector can be disposed close to a slotted region of the free end of the shaft tube, within which slotted region the dispersing rotor is provided. It is thus possible to record the temperature as close as possible to the dispersing rotor without however jeopardizing the temperature detector as a result of the turbulences arising from the cooperation of the dispersing rotor with the slotted region of the shaft tube.

It can also be favorable if the input and output line of the temperature detector is disposed in the direction of extent of the longitudinal center axis of the shaft tube, i.e. parallel thereto.

BRIEF DESCRIPTION OF THE DRAWINGS

An illustrative embodiment of the invention is described in greater detail below with reference to the figures of the drawing, wherein, in partially schematized representation.

DETAILED DESCRIPTION OF THE PREFERRED EMBODIMENTS

Figure 1:
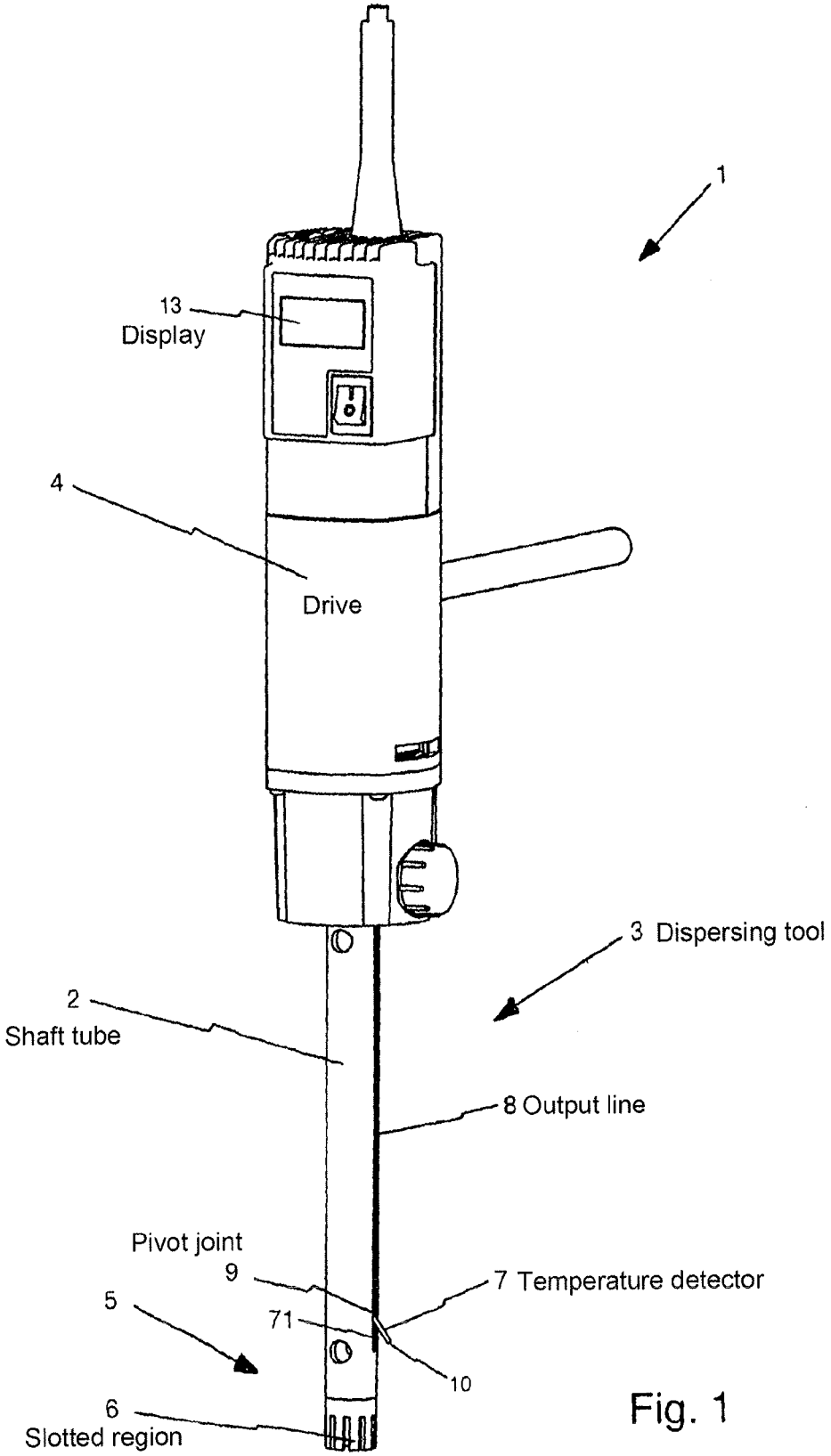
FIG. 1 shows a diagrammatic side view of an inventive dispersing device comprising a dispersing tool coupled to a drive and having a temperature detector close to that region of its shaft tube which is slotted for the dispersion.

A dispersing device, denoted in its entirety by 1 has according to FIG. 1 a dispersing tool 3, which has a shaft tube 2 and on the free, in the usage position, lower end 5 of which, facing away from a drive 4, is provided a laterally slotted region 6. Within this laterally slotted region 6 is found a dispersing rotor (not visible in the figures), which is driven via a shaft and which, in cooperation with the slotted region 6, transmits to the medium to be dispersed the shearing forces necessary for the dispersion and, in this respect, corresponds to the dispersing tool according to DE 10 2004 009 708 B3. The slots of this region 6 here run parallel to the longitudinal extent of the shaft tube 2 and are open in the direction of the free end 5.

Figure 2:
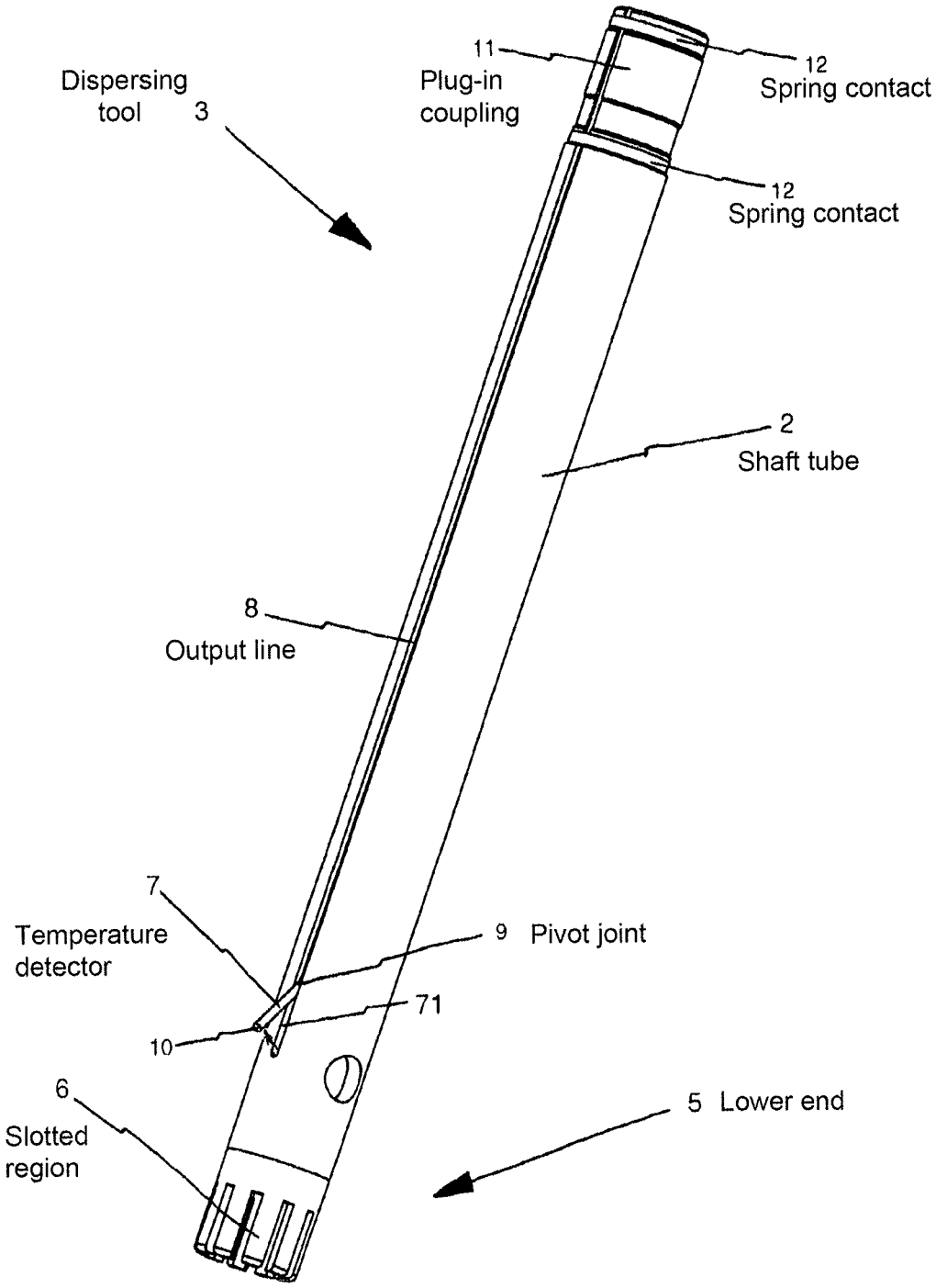
FIG. 2 shows on an enlarged scale a perspective side view of the dispersing tool, separate from the drive of the dispersing device represented in FIG. 1, having a temperature detector, located in the usage position, close to the free end of the shaft tube, and having a plug-in coupling having two electrical contacts, which contacts serve for the transfer of the measurement signals, transmitted via the input and output line, to the drive and/or to an electronic evaluation unit and/or a regulating device.

According to FIGS. 1 and 2, a temperature detector 7 with an associated electrical input and output line 8 disposed on the outer side of the shaft tube 2 is provided on the free end 5. According to FIG. 2, the input and output line 8 runs from the temperature detector 7 via the outer side of the shaft tube 2 in the direction of the drive 4 and connects this, in the coupled-up usage position of the dispersing tool 3, to the temperature detector 7.

In order to be able to determine the temperature of the medium to be dispersed, without disturbance from a possible build-up of heat, the temperature detector 7 is thermally isolated from the shaft tube 2 receiving the shaft.

Both figures show that the temperature detector 7, for its isolation from the outer side of the shaft tube 2, protrudes obliquely or is angled-off or bent and is disposed in the region of that end 5 of the shaft tube 2 which is facing away from the drive 4.

FIG. 2 further shows that the temperature detector 7 is pivotable away from the outer side of the shaft tube 2, via a pivot joint 9 disposed on the shaft tube 2, from said pivot joint into its protruding and thereby isolated usage position.

If the temperature detector 7 is pivoted back into a position bearing against the shaft tube 2, it can be sunk in a recess or in a groove 71, so that it does not project beyond the outer contour of the shaft tube 2 and is well protected. This is advantageous, in particular, for the storage of the dispersing tool 3, since the temperature detector 7 can thus be well protected from possible damage.

It is here possible for the temperature detector 7 to be able to be deployed from the shaft tube 2 by a spring force (indicated by the small arrow in FIG. 2) of a spring element (not represented in the figures).

That embodiment of the invention which is represented in the figures has a temperature detector 7, which protrudes at an acute angle and with its end 10 proximate to the free end of the shaft tube 5, so as to assume a maximum possible distance to the shaft tube 2.

One embodiment of the invention (not represented in the figures) can also provide, however, that the temperature detector 7 protrudes from the shaft tube 2 in the reverse direction and/or, for instance, at right angles.

In particular, FIG. 2 shows that the input and output line 8, which connects the temperature detector 7 to an electronic evaluation unit and/or to the drive 4, as can be seen from FIG. 1, is disposed on the outer side of the shaft tube 2. It is here also conceivable for the input and output line 8 to be disposed within the shaft tube 2.

The preferred embodiment of the invention provides that the input and output line 8 is a metal and/or gold coating which exhibits particularly good electrical conductivity. The use of an electrically conductive film and/or a hybrid of film and metal coating as an input and output line 8, which is fastened, in particular, to the outer side of the shaft tube 2, is likewise possible.

In FIG. 2 it can be seen that the input and output line 8 of the temperature detector 7 is applied to, in particular is vapor-coated onto the outer side of the shaft tube 2.

It is also possible to arrange the input and output line such that it is embedded in sunken arrangement within a groove on the outer side of the shaft tube 2. This groove could also be recessed into the inner side of the shaft tube 2 or into its inside surface.

In a non-represented embodiment of the invention, the input and output line 8 is formed by a cable and/or a cable connection. For the reception of this cable or this cable connection, the shaft tube 2 is here provided with a channel of optional cross section, which channel securely fixes and safely shields this input and output line 8.

According to FIG. 2, the dispersing tool 3 has for mechanical connection to the drive 4 a plug-in coupling 11 on that end of the shaft tube 2 which, in the usage position of the dispersing tool 3, is facing the drive 4. FIG. 2 further shows that this plug-in coupling 11 has electrical contacts, in the present illustrative embodiment two spring contacts 12, via which the input and output line 8 of the temperature detector 7 is electrically contacted with the drive 4 and/or the electronic evaluation unit.

For the use of the dispersing device 1 in a partially automated and/or fully automated dispersion process, the drive 4 and/or the electronic evaluation unit is equipped with a control or regulating device for the drive 4 for processing the measurement data of the temperature detector 7 and for controlling or regulating the drive 4. With the aid of the control or regulating device, dispersion operations can be controlled or regulated automatically in dependence on the prevailing temperature of the medium or dispersing agent.

If the heat input into the dispersing agent through the rapidly rotating dispersing rotor is too large, for example, and its temperature is already reaching a preset limit value, the speed of the shaft and of the dispersing rotor can be reduced until such time as the medium has cooled off again or the drive 4 can be shut down by the control or regulating device.

According to FIG. 1, the dispersing device 1 has a display 13 for displaying the operating parameters, in particular for displaying the temperature values measured by the temperature detector 7.

Furthermore, it is possible for the temperature detector 7, in the usage position of the dispersing device 1, to be displaceable on the shaft tube 2 in the vertical direction. If the temperature detector 7 on the shaft tube 2 and/or in a groove is provided with a linear actuating drive, its height adjustment can even be realized automatically.

A further embodiment (not represented in the figures) provides that the dispersing device 1 has in addition to the temperature detector 7 a moisture sensor. Any dry running of the dispersing device 1 due to a reduction in the level of the medium, for instance, is promptly detected, and damage which could consequently arise, in particular on the bearing of the shaft, is thus avoided.

The moisture sensor is here disposed preferably at the same height or at the same distance from the slotted region 6 and at the same place as the temperature detector 7 on the shaft tube 2, or else is directly connected to the temperature detector 7 or fastened thereto. The moisture sensor can thus be deployed from the shaft tube 2, jointly with the temperature detector 7, into the usage position and, on the basis of a moisture measurement, a check can reliably be made on whether the temperature detector 7 is properly positioned in the medium to be dispersed or whether it is found outside the medium and there measures the temperature of the surrounding air.

In order to be able to check and monitor the position of the temperature detector 7 with sufficient accuracy, even at different and/or changing fill level heights or levels of the medium to be dispersed, the moisture sensor in another embodiment of the invention is attached together with the temperature detector 7, in a manner already described, in usage position to the shaft tube 2, such that it is height-adjustable in the vertical direction.

The dispersing device, denoted in its entirety by 1, has a dispersing tool 3, which has a shaft tube 2, and a drive 4. On the free end 5, facing away from the drive 4, of the shaft tube 2 is provided a dispersing rotor, which is connected to the drive 4 via a shaft which can be coupled to the drive 4 and is disposed within the shaft tube 2. For the monitoring of the temperature of the medium to be dispersed, a temperature detector 7 with associated electrical input and output line 8, which input and output line 8 connects the temperature detector 7 to the drive 4 and/or an electronic evaluation unit and/or a control or regulating device, is provided on the shaft tube 2, which is fixed relative to the dispersing rotor and the rotatable shaft.

The invention claimed is:

1. A dispersing device (1) comprising a dispersing tool (3) and a drive (4), the dispersing tool (3) has a fixed shaft tube (2) and on a free end (5) of which, facing away from the drive (4), is provided a dispersing rotor which is drivable via a rotatable shaft connected to the drive (4) and disposed in the fixed shaft tube (2), a temperature detector (7) with an associated electrical input and output line (8) is disposed on the fixed shaft tube (2) and forms a fixed connection with the fixed shaft tube, the temperature detector being located on an outer side of the fixed shaft tube and configured for insertion with the fixed shaft tube and the dispersing rotor into direct contact with a medium being dispersed.

2. The dispersing device as claimed in claim 1, wherein the temperature detector (7) protrudes away from the shaft tube (2) creating an isolating distance so that the temperature detector (7) is thermally isolated from the shaft tube (2) which receives the shaft.

3. The dispersing device as claimed in claim 1, wherein the temperature detector (7) is disposed, such that it protrudes in at least one of an angled-off or bent arrangement, on an outer side of the shaft tube (2), in a region of the free end of the shaft tube (2) which is facing away from the drive.

4. The dispersing device as claimed in claim 1, wherein the temperature detector (7) is pivotable away from an outer side of the shaft tube (2), via a pivot joint (9) disposed on the shaft tube (2), from said pivot joint into a protruding usage position.

5. The dispersing device as claimed in claim 1, wherein the temperature detector (7) is deployable from the shaft tube (2) by a spring force.

6. The dispersing device as claimed in claim 1, wherein an end (10) of the temperature detector (7) which is close to the free end (5) of the shaft tube (2) protrudes from the shaft tube (2).

7. The dispersing device as claimed in claim 1, wherein the temperature detector (7) in a usage position protrudes from the shaft tube (2) at an acute angle.

8. The dispersing device as claimed in claim 1, wherein the input and the output line (8) connect the temperature detector (7) to at least one of an electronic evaluation unit or the drive (4) is disposed on one of a outer side of the shaft tube (2) or within the shaft tube (2).

9. The dispersing device as claimed in claim 1, wherein the input and the output line (7) are at least one of a metal, gold coating, or an electrically conductive film, which is fastened to an outer side of the shaft tube (2).

10. The dispersing device as claimed in claim 1, wherein the input and the output line (8) of the temperature detector (7) is disposed within at least one of a groove or recess provided on the outer side of the shaft tube (2).

11. The dispersing device as claimed in claim 1, wherein the input and the output line (8) are formed by at least one of a cable or a cable connection.

12. The dispersing device as claimed in claim 1, wherein the shaft tube (2) has a channel for reception of the input and the output line (8) of the temperature detector (7).

13. The dispersing device as claimed in claim 1, wherein the dispersing tool (3), for connection to the drive (4), has a plug-in coupling (11) on an end of the shaft tube (2) which in a usage position is facing the drive (4), the plug-in coupling (11) having electrical contacts via which the input and the output line (8) of the temperature detector (7) are electrically contacted with at least one of the drive (4) or an electronic evaluation unit.

14. The dispersing device as claimed in claim 13, wherein the drive (4) or the electronic evaluation unit has a regulating device for the drive (4) for processing measurement data of the temperature detector (7) and for regulating the drive (4).

15. The dispersing device as claimed in claim 1, further comprising a display (13) for displaying operating parameters.

16. The dispersing device as claimed in claim 1, wherein the temperature detector (7) is disposed close to a slotted region (6) of the free end (5) of the shaft tube (2), within which slotted region (6) the dispersing rotor is provided.

17. The dispersing device as claimed in claim 1, wherein the input and the output line (8) of the temperature detector (7) are disposed in a direction of extent of a longitudinal center axis of the shaft tube (2).

* * * * *